US007820011B2

(12) United States Patent
Almi et al.

(10) Patent No.: US 7,820,011 B2
(45) Date of Patent: Oct. 26, 2010

(54) MOISTENING NOZZLE OF A PAPER WEB

(75) Inventors: Jari Almi, Pirkkala (FI); Niko Posti, Tampere (FI); Hannu Niemelä, Tampere (FI)

(73) Assignee: Metso Automation Oy, Helsinki (FI)

( * ) Notice: Subject to any disclaimer, the term of this patent is extended or adjusted under 35 U.S.C. 154(b) by 847 days.

(21) Appl. No.: 11/658,313

(22) PCT Filed: Jul. 7, 2005

(86) PCT No.: PCT/FI2005/050273

§ 371 (c)(1),
(2), (4) Date: May 1, 2007

(87) PCT Pub. No.: WO2006/010796

PCT Pub. Date: Feb. 2, 2006

(65) Prior Publication Data

US 2008/0308245 A1 Dec. 18, 2008

(30) Foreign Application Priority Data

Jul. 30, 2004 (FI) ..... 20045284

(51) Int. Cl.
*D21H 23/50* (2006.01)
*B05B 7/26* (2006.01)

(52) U.S. Cl. ..... 162/207; 162/275; 239/405

(58) Field of Classification Search ..... 162/195, 162/207, 275, 361; 239/8, 405, 406
See application file for complete search history.

(56) References Cited

U.S. PATENT DOCUMENTS

| | | | | |
|---|---|---|---|---|
| 1,547,349 | A * | 7/1925 | Reichenbach | 239/405 |
| 3,948,721 | A * | 4/1976 | Winheim | 162/207 |
| 4,946,101 | A | 8/1990 | Winheim | |
| 5,431,343 | A * | 7/1995 | Kubiak et al. | 239/105 |
| 5,680,987 | A | 10/1997 | Taylor | |
| 6,334,579 | B1 * | 1/2002 | Zarbi | 239/406 |
| 2004/0261965 | A1 * | 12/2004 | Burma | 162/198 |

FOREIGN PATENT DOCUMENTS

| | | |
|---|---|---|
| DE | 952 765 | 4/1957 |
| FI | 91 366 | 12/1989 |
| GB | 518 496 | 8/1938 |
| SU | 1 186 721 A | 10/1985 |
| WO | WO 97/34033 A2 | 9/1997 |

* cited by examiner

*Primary Examiner*—Eric Hug
(74) *Attorney, Agent, or Firm*—Oliff & Berridge PLC

(57) ABSTRACT

A moistening nozzle of a paper web comprises a frame (1) into which air and water are conducted. Inside the frame (1) there is arranged a water nozzle (2) wherewith water is conducted to an outlet of the moistening nozzle and an air nozzle wherewith air is correspondingly conducted to the outlet. The air nozzle (3) and the water nozzle (2) are arranged one within the other such that the air and the water form water mist that is blown out from the moistening nozzle. The air nozzle (3) is provided with an inner thread (10) that brings the air in swirling motion.

14 Claims, 2 Drawing Sheets

MOISTENING NOZZLE OF A PAPER WEB

BACKGROUND OF THE INVENTION

The invention relates to a moistening nozzle of a paper web comprising a frame to which air and water is conducted, a water nozzle which is arranged inside the frame and wherewith water is conducted to the outlet of the moistening nozzle and an air nozzle wherewith air is conducted to the outlet of the moistening nozzle, and in connection with the air nozzle there are threads that bring the air into swirling motion and the air nozzle and the water nozzle are arranged one within the other to allow the air and the water to produce water mist that is sprayed out from the moistening nozzle.

The paper web is moistened to control the moisture profile of the paper web, for instance. Moistening can also be employed to control the curling of the paper web on the paper machine. Further, in online calendering, for instance, the management of given quality parameters requires moistening of good quality with water.

The paper web is moistened with a moistening apparatus that comprises a plurality of moistening nozzles in the cross direction of the paper web, which nozzles are used for blowing water mist containing air and water onto the surface of the paper web. DE 952 765 discloses a moistening nozzle. Said moistening nozzle comprises an air nozzle and a water nozzle arranged nested therein. The air nozzle comprises an external thread that brings the air into swirling motion. The swirling air that flows out captures the water from the periphery to form small particles. Said moistening nozzle provides a hollow cone spray pattern. The air and water nozzle are arranged inside the frame of the moistening nozzle with a mutual threaded joint in as centralized a manner as possible so that a gap between them is as even as possible. Due to the securing manner it is difficult to achieve or maintain centricity and evenness of the gap and consequently the spray pattern differs easily from the desired shape. All in all, the structure of the moistening nozzle is relatively difficult in the respect that it is very difficult to make moistening nozzles providing homogeneous sprays.

FI publication 91 366 discloses a moistening nozzle for a paper web, which also comprises a water nozzle in the middle of the moistening nozzle frame and an air nozzle arranged outside the water nozzle. In connection with the air nozzle there is a spiral piece with an external thread to bring the air flow into swirling motion. The water nozzle and the air nozzle are mutually arranged to secure one another. In addition, between the air nozzle and the water nozzle there is provided a ring-shaped gap whose width in the circumferential direction remains unchanged. The structure of this moistening nozzle is relatively complicated and therefore the moistening nozzle is difficult to manufacture. All in all, it is relatively difficult to center the air nozzle and the water nozzle in the moistening nozzle, and consequently it is very difficult to manufacture moistening nozzles that provide mutually homogeneous sprays.

BRIEF DESCRIPTION OF THE INVENTION

The object of the invention is to provide a moistening nozzle of a novel type for a paper web.

The moistening nozzle of the paper web in accordance with the invention is characterized in that an air nozzle comprises an internal thread.

The basic idea of the invention is that the moistening nozzle comprises a frame to which air and water are conducted. Inside the frame there is arranged a water nozzle wherewith the water is conducted to an outlet of the moistening nozzle, and an air nozzle wherewith the air is correspondingly conducted to the outlet. The air nozzle and the water nozzle are nested one within the other so that the air and the water form water mist that is blown out from the moistening nozzle. The air nozzle comprises a thread that brings the air into swirling motion. Further, it is substantial that the air nozzle thread is an internal thread. That enables a very good and even spray. Providing threads on the inner surface of the air nozzle further enables an embodiment in which the outer surface of the air nozzle is supported to the frame of the moistening nozzle. Thus the air nozzle can be supported accurately with slight tolerance to a desired point and the water spray provided by the moistening nozzle is even. The basic idea of a second embodiment is to support the outer surface of both an air nozzle and a water nozzle to the frame of the moistening nozzle whereby the control surfaces provided on the frame can be made with one machining piece connection. Consequently the air nozzle and the water nozzle can be mounted to place very accurately and the moistening nozzles will be of uniform quality. The basic idea of a third embodiment is that a water nozzle is provided with at least two axially spaced control surfaces by which it is supported to the frame of the moistening nozzle. Thus successive control surfaces make it possible to ensure in a simple and accurate manner that the water nozzle is correctly positioned and stays in the right direction.

It is set forth in this description that air and water are used for moistening, but the use of other gases and liquids is also possible, so in connection with this description the term 'air' refers to any gas or gas mixture usable in connection with paper web moistening, and correspondingly, the term 'water' refers to any liquid or liquid mixture suitable for paper web moistening.

BRIEF DESCRIPTION OF THE DRAWINGS

In the following the invention will be described in greater detail in the attached drawings, wherein.

For the sake of clarity the invention is depicted simplified in the figures.

DETAILED DESCRIPTION OF THE INVENTION

Figure 1:
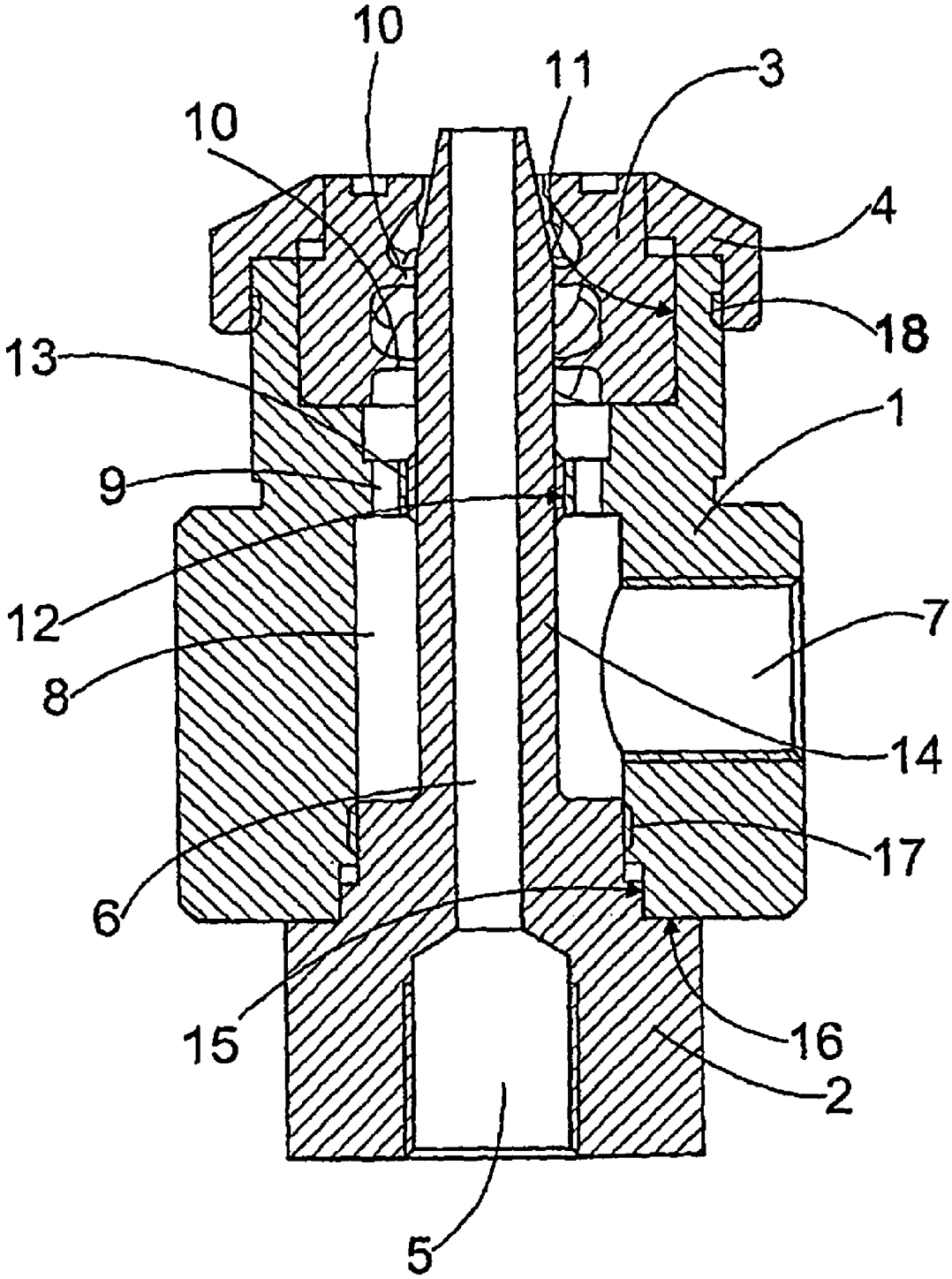
FIG. 1 is a schematic cross-sectional side view of a moistening nozzle of a paper web.

FIG. 1 shows a moistening nozzle having a frame 1. Inside the frame 1 there is arranged a water nozzle 2. The water nozzle 2 is connected to the inside of the frame 1 with a threaded joint 17. Further, inside the frame 1 there is arranged an air nozzle 3 such that the water nozzle 2 and the air nozzle 3 are concentric. The air nozzle 3 is secured to the frame 1 with a securing nut 4 that is connected to the exterior of the frame 1 with a threaded joint 18.

The water nozzle 2 includes a water connector 5, into which water is fed with a pipe or a hose or the like. The water connector 5 comprises, for instance, a thread for connecting the pipe or the hose. From the water connector 5 the water flows through a water duct 6 out of the water nozzle. In the frame 1 there is arranged an air connector 7, to which a pipe or a hose or the like is connected with a threaded joint, for instance, for feeding air to the moistening nozzle. The water is fed into the moistening nozzle, i.e. in the middle of the moistening nozzle, from the rear part thereof, and the air is fed to the moistening nozzle from the side of the moistening nozzle.

From the air connector 7 the air is conducted to an air chamber 8 that is arranged around a shaft 14 of the water nozzle. From the air chamber 8 the air flows through apertures 9 in the frame 1 towards the air nozzle 3.

The air nozzle 3 comprises an internal thread 10 which is provided on the inner surface of the air nozzle 3 and by which the air is brought to swirling motion. The air in swirling motion thus flows through an air gap 20 in the moistening nozzle to surround the water from the water nozzle 2, whereby the mixture of water and air form water mist. Thanks to the swirling motion the water mist forms an even cone-shaped spray.

The air nozzle 3 is arranged inside the frame 1 such that the air nozzle is positioned into place against a control surface 11 of the air nozzle inside the frame 1. The control surface 11 of the air nozzle is located around the central axis in the circumferential direction. The water nozzle 2, in turn, is positioned to place against a first control surface 12 of the water nozzle provided on the inner surface of the frame 1. On the shaft 14 of the water nozzle 2 it is possible to provide a collar 13 by which the water nozzle 2 is supported against the first control surface 12 of the water nozzle. The first control surface 12 of the water nozzle is also in the direction of the circumference around the axis of the moistening nozzle. Thanks to this structure the control surface 11 of the air nozzle and the first control surface 12 of the water nozzle can be provided on the frame 1 with one attachment of a machining piece, whereby they can be made concentric with close tolerance and the air nozzle 3 and the water nozzle 2 can be mutually centred with very good accuracy. In the frame 1 of the moistening nozzle there is provided a second control surface 15 of the water nozzle, which is located in the axial direction of the moistening nozzle spaced from the first control surface 12 of the water nozzle. The second control surface 15 of the water nozzle is also in the direction of the circumference around the axis of the moistening nozzle. As the first control surface 12 and the second control surface 13 of the water nozzle are axially spaced from one another, it is possible to mount the water nozzle 2 accurately into place so that the tip of the water nozzle 2 is precisely in a correct position with respect to the outlet opening of the air nozzle 3. To position the water nozzle 2 there is still arranged in the frame 1 a third control surface 16 that is provided in the frame 1 such that the third control surface of said water nozzle is transversal to the axis of the moistening nozzle. Thus the water nozzle 2 can be fitted very accurately into place. The threads between the water nozzle 2 and the frame 1 are arranged such that the third control surface 16 of the water nozzle stops the water nozzle 2 to a correct position with respect to the frame 1 before the threads between the frame and the water nozzle 2 are fully screwed. Thus the fact that there are no more threads will not tilt the water nozzle 2 into a wrong position.

Between the different pieces of the moistening nozzle it is possible to arrange seals in necessary places. The seals may be O-ring seals of EPDM rubber, for instance.

The air nozzle 3 is advantageously provided by moulding it in one piece. If desired, the air nozzle 3 may also consist of several pieces. The air nozzle 3 can be made of plastic or another material suitable for moulding, for instance, by injection moulding. The plastic material should be such that it does not absorb water and resists heat at least 180° C. One plastic grade suitable for the purpose is polyethersulphone PES.

When the air nozzle 3 is manufactured by moulding, it is relatively easy to make air nozzles with various threads 10, for instance. Thus, by changing the air nozzle in the moistening nozzle it is possible to provide various spray patterns. For instance, the angle of the threads 10 may vary within the range of 0 to 90 degrees. Further, the depth of thread may vary in the desired manner. Other parts of the moistening nozzle may be made of steel, for instance.

Figure 2:
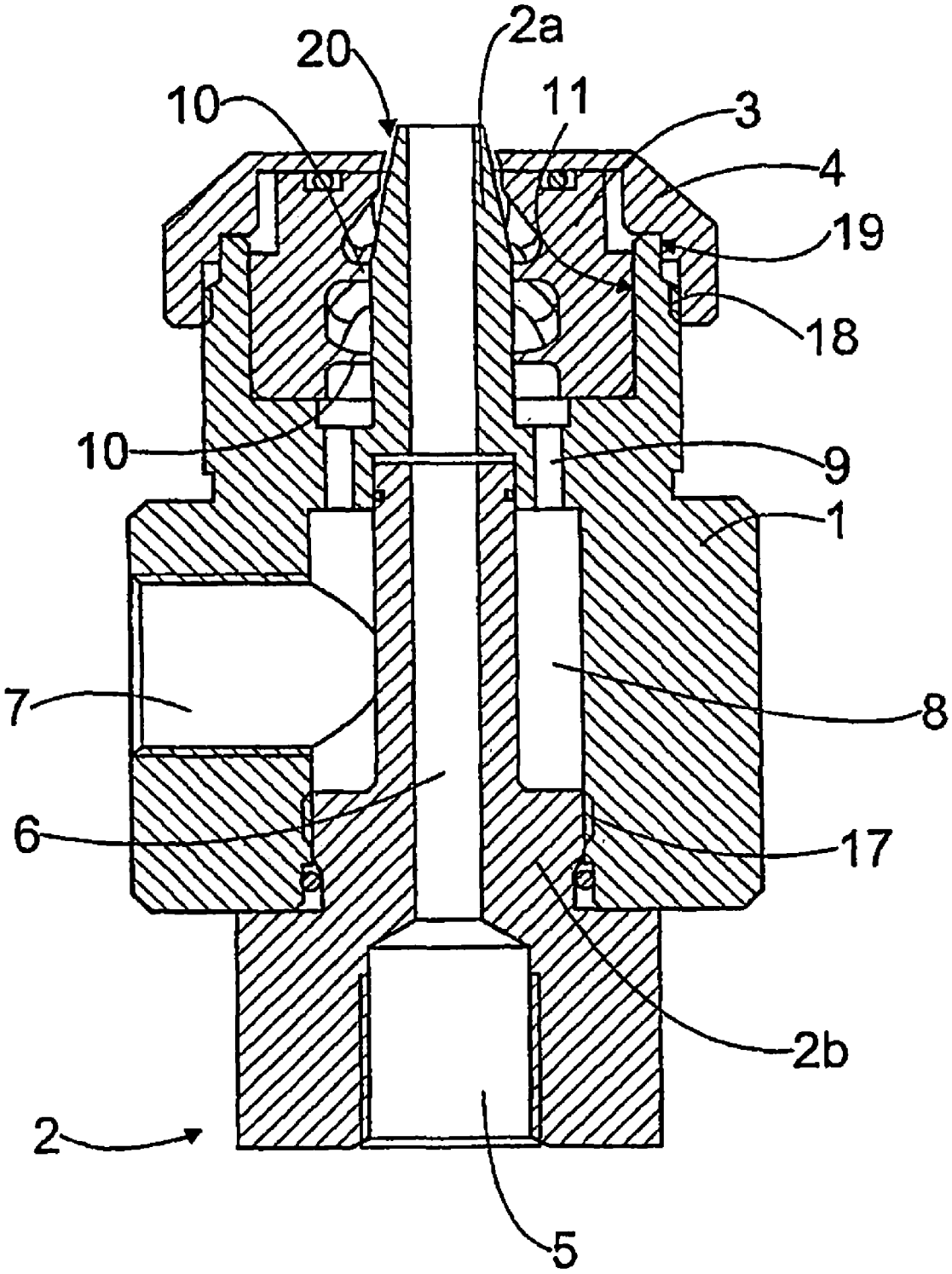
FIG. 2 is a schematic cross-sectional side view of a second moistening nozzle of a paper web.

FIG. 2 shows an embodiment, in which the water nozzle 2 consists of two pieces. The tip part 2*a* of the water nozzle, i.e. the nozzle pipe, is provided to form an integral part of the nozzle frame 1. Thus the tip part 2*a* of the water nozzle and a control surface 11 of the air nozzle can be machined in the same machining step and with one attachment of the machining tool. In this manner it is possible to set the air nozzle 3 and the tip part 2*a* of the water nozzle very accurately into place with respect to one another, which ensures a very good and even spray. Thanks to the structure it is also very easy to assemble the nozzle correctly and the dimensional accuracy of the air gap 20 will be retained as the moistening nozzle ages.

The rear part 2*b* of the water nozzle, i.e. a hollow conductor, is a separate piece and it is secured to the frame 1 with a threaded joint 17. The tolerances in the interconnection of the rear part 2*b* of the water nozzle and the frame 1 need not be very accurate, but nevertheless the moistening nozzle produces an even spray. It will suffice that the rear part 2*b* is tightly secured to the frame 1 such that the water runs smoothly through the water duct 6. If desired, the water nozzle 2 in the whole could be made to form an integral part of the nozzle frame 1, but for instance, when the moistening nozzle is made of metal the manufacturing of a piece by machining is considerably easier if the rear part 2*b* of the water nozzle is a separate piece that is secured to the frame 1.

FIG. 2 further shows an embodiment, in which the centre part of a securing nut 4 extends to the vicinity of the tip part 2*b* of the water nozzle. In the case of FIG. 1 the size of an air gap 20 outside the water nozzle 2 is mainly determined by the inner surface of the air nozzle 3. In the case of FIG. 2, in turn, the dimensions of the tip part 2*a* of the water nozzle and the securing nut 4 determine the size and shape of said air gap 20. The size and shape of the air gap 20 have a considerable effect on the operation of the nozzle as regards moistening response. Advantageously the air gap 20 is ring-shaped and concentric with the water nozzle 2, but it may also have some other shape. On the outer surface of the frame 1 there is a control surface 19 of the securing nut. The control surface 19 of the securing nut is around the central axis of the moistening nozzle in the circumferential direction. By means of the control surface 19 the securing nut 4 is positioned into place. As the tip part 2*a* of the water nozzle, the threaded joint 18 and the control surface 19 of the securing nut can be machined in the same machining step and with one attachment of the machining tool, the tip part 2*a* of the water nozzle and the securing nut 4 can be mutually mounted into place with great accuracy. Consequently, the air gap 20 between the tip part 2*a* and the securing nut 4 can be formed with great accuracy to have a desired shape, which ensures very good and even spray. Thanks to the structure it is also very easy to assemble the nozzle correctly and the dimensional accuracy of the air gap 20 will be retained as the moistening nozzle ages.

Advantageously the air nozzle 3 is manufactured by moulding into one piece. Moulding within the limits of the dimensional accuracy requirements set for the air nozzle 3 is relatively difficult, however. Instead, when the securing nut 4 is made of metal by machining, the dimensions thereof will be accurate. In addition, when the securing nut 4 is arranged in the above-described manner accurately concentric with the tip part 2*a* of the water nozzle, the air gap 20 will be provided to have precisely the desired shape, and consequently the function of the air nozzle 3 is just to bring the air into swirling motion.

In some cases the features set forth in this document can be used as such, irrespective of other features. On the other hand, when necessary, the features set forth in this document can be combined to provide various combinations.

The drawings and the relating description are only intended to illustrate the inventive idea. The details of the invention may vary within the scope of the claims. Thus, for instance, the threads 10 provided in the air nozzle 3 can be formed to make the air spray swirl clockwise or anticlockwise. On the other hand, it is also possible to manufacture some of the moistening nozzles such that the spray swirls clockwise and others such that the air spray swirls anticlockwise. In that case some of the moistening nozzles can be mounted on the moistening apparatus such that the spray swirls clockwise and others such that the spray swirls anticlockwise, and consequently a homogeneous moistening response can be achieved in the moistening apparatus by altering the construction of the nozzle. Instead of the control surfaces in the circumferential direction as shown in FIG. 1, the control surfaces may be cone-shaped, for instance. Further, the control surfaces need not be continuous but it will suffice that the control surface provides support at least at three different points from different directions. Technically, however, a continuous, rotationally symmetrical control surface is easiest to manufacture for the moistening nozzle. Yet instead of the threaded joints it is possible to use welded or glued joints or other joints suitable for the purpose.

The invention claimed is:

1. A moistening nozzle of a paper web comprising a frame to which air and water are fed, a water nozzle which is arranged inside the frame and wherewith water is conducted to an outlet of the moistening nozzle and an air nozzle wherewith air is conducted to an outlet of the moistening nozzle, and the air nozzle has an internal thread that brings the air into swirling motion, the internal threads formed on an inner surface of the air nozzle, and the air nozzle and the water nozzle are arranged one within the other to allow the air and the water to produce water mist that is sprayed out from the moistening nozzle, wherein inside the frame there is a control surface of the air nozzle to which the outer surface of the air nozzle is supported and the air nozzle is mounted into place by means of a securing unit.

2. A moistening nozzle of a paper web as claimed in claim 1, wherein the air nozzle is a moulded piece.

3. A moistening nozzle of a paper web as claimed in claim 2, wherein the air nozzle is made of plastic.

4. A moistening nozzle of a paper web as claimed in claim 1, wherein the control surface of the air nozzle is in the direction of the circumference around the central axis of the moistening nozzle.

5. A moistening nozzle of a paper web as claimed in claim 1, wherein on the inner surface of the frame there is a first control surface of the water nozzle, and the outer surfaces of both the air nozzle and the water nozzle are supported to the frame of the moistening nozzle.

6. A moistening nozzle of a paper web as claimed in claim 5, wherein the first control surface of the water nozzle is in the direction of the circumference around the central axis of the moistening nozzle.

7. A moistening nozzle of a paper web as claimed in claim 5, wherein on the inner surface of the frame there is a second control surface of the water nozzle, which is axially spaced from the first control surface of the water nozzle.

8. A moistening nozzle of a paper web as claimed in claim 7, wherein the second control surface of the water nozzle is in the direction of the circumference around the central axis of the moistening nozzle.

9. A moistening nozzle of a paper web as claimed in claim 7, wherein the second control surface of the water nozzle is transversal to the axis of the moistening nozzle.

10. A moistening nozzle of a paper web as claimed in claim 1, wherein the tip part of the water nozzle is an integral part of the frame.

11. A moistening nozzle of a paper web as claimed in claim 1, wherein the centre part of the securing nut extends to the vicinity of the tip part of the water nozzle such that the tip part of the water nozzle and the securing nut determine the size of a water gap outside the water nozzle.

12. A moistening nozzle of a paper web as claimed in claim 11, wherein on the outer surface of the frame there is a control surface for the securing nut to which the inner surface of the securing nut is supported.

13. A moistening nozzle of a paper web as claimed in claim 12, wherein the control surface for the securing nut is in the direction of the circumference around the central axis of the moistening nozzle.

14. A moistening nozzle of a paper web as claimed in claim 7, wherein in the frame there is a third control surface of the water nozzle that is transversal to the axis of the moistening nozzle.

* * * * *